US005952601A

United States Patent [19]

Sanford et al.

[11] Patent Number: 5,952,601

[45] Date of Patent: Sep. 14, 1999

[54] RECOILLESS AND GAS-FREE PROJECTILE PROPULSION

[75] Inventors: Matthew J. Sanford, Bel Alton, Md.; Larry E. Crabtree, Falmouth, Va.; Roger L. Ellis; James F. Cahill, both of Fredericksburg, Va.

[73] Assignee: The United States of America as represented by the Secretary of the Navy, Washington, D.C.

[21] Appl. No.: 09/064,717

[22] Filed: Apr. 23, 1998

[51] Int. Cl.[6] ..... F41A 1/08

[52] U.S. Cl. ..... 89/1.706; 89/1.7; 89/1.704

[58] Field of Search ..... 89/1.7, 1.701, 89/1.702, 1.703, 1.704, 1.705, 1.706

[56] References Cited

U.S. PATENT DOCUMENTS

| | | | |
|---|---|---|---|
| 4,148,244 | 4/1979 | Schnäbele et al. | 89/1.701 |
| 5,099,764 | 3/1992 | Dale et al. | 102/374 |
| 5,285,713 | 2/1994 | Brage | 89/1.704 |
| 5,313,870 | 5/1994 | Clark | 89/1.704 |
| 5,337,648 | 8/1994 | Brage | 89/1.704 |
| 5,357,841 | 10/1994 | Clark et al. | 89/1.701 |
| 5,551,330 | 9/1996 | Reuche | 89/1.701 |

*Primary Examiner*—Charles T. Jordan
*Assistant Examiner*—Jeff Howell
*Attorney, Agent, or Firm*—James B. Bechtel, Esq.

[57] ABSTRACT

A recoilless and gas-free projectile propulsion device is provided. A hollow pressure vessel is sealed on a first end to an aft end of a projectile in a launch tube. The pressure vessel is further open on a second end. A propellant charge-filled pressure chamber, defined in a forward portion of the pressure vessel, has holes venting to the pressure vessel aft thereof. A piston, sealed within the pressure vessel for sliding movement therein, is spaced apart from the pressure chamber to define a volume therebetween that receives gases produced during the burning of the propellant charge via the vent holes. A pressure valve divides the volume into a forward section adjacent the pressure chamber and an aft section adjacent the piston. The pressure valve remains closed until a threshold pressure is reached in the forward section at which point the pressure valve opens to join the forward section with the aft section. A countermass is positioned between the piston and the second end of the pressure vessel. When the pressure valve opens, the gases in the volume act on the pressure chamber and the piston. As a result, the projectile with the pressure vessel sealed thereto is propelled forward while the piston moves aft. The piston travels to the second end of the pressure vessel to drive the countermass (e.g., a fluid) out of the pressure vessel at its second end while the gases remain sealed in the pressure vessel which is launched with the projectile.

19 Claims, 1 Drawing Sheet

RECOILLESS AND GAS-FREE PROJECTILE PROPULSION

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to projectile propulsion, and more particularly to a device that provides for the recoilless launching of a projectile from a launch tube while containing propulsion gases.

BACKGROUND OF THE INVENTION

Propelling charge (or prop charge as it is known) propulsion operates by generating a reaction force acting on the cross-sectional area of the aft end of a projectile. A typical prop charge is a powder or grain tamped in a combustion chamber. For a proper launch, the prop charge must be burned efficiently and at a steady, fast rate. In many applications, the projectile is launched from a tube which can be supported on a mount or by an individual.

At launch, the burning prop charge generates exhaust gases. Accordingly, handling of the exhaust gases is an ongoing concern. If exhaust gas exits the back end of the launch tube, disadvantages include the creation of a potentially lethal zone behind the launcher caused by the shock waves, the presence of turbulent hot toxic gases, the generation of considerable sound and pressure levels, and the discharge of flash and smoke. These disadvantages therefore generally prevent the use of such launchers in confined or closed spaces, or in covert operations.

In addition to the discharge of lethal exhaust gases, recoil forces are another concern in prop charge propulsion. To counter recoil forces, a countermass is required. The prop charge is typically sandwiched between the projectile to be fired out the front of the tube and a countermass to be discharged out the rear of the tube. The choice of countermass is an obvious concern because it endangers anything in its path. In general, the discharged countermass is inherently dangerous because it involves a solid or particle mass followed by or mixed with toxic and/or hot gases. Further, the noise, visual and/or thermal signature associated with the discharged countermass and gases can be detected thereby revealing the location of the launching man or crew.

SUMMARY OF THE INVENTION

Accordingly, it is an object of the present invention to provide a device that safely handles exhaust gases produced by a propellant charge burned in a launch tube.

Another object of the present invention is to provide a device that compensates for recoil forces generated by the propulsion of a projectile from a launch tube.

Still another object of the present invention is to provide a device that efficiently burns a propellant.

Yet another object of the present invention is to provide a device that minimizes the noise and visual signatures usually associated with exhaust gases produced by a propellant charge burned in a launch tube.

Other objects and advantages of the present invention will become more obvious hereinafter in the specification and drawings.

In accordance with the present invention, a device for the recoilless propulsion of a projectile from a launch tube has a hollow pressure vessel sealed on a first end thereof to an aft end of the projectile in a launch tube. The pressure vessel is further open on a second end thereof. A pressure chamber is defined in a forward portion of the pressure vessel. The pressure chamber has holes venting to the pressure vessel aft of the pressure chamber. A propellant charge is loaded into the pressure chamber. A piston is sealed within the pressure vessel for sliding movement therein. The piston is spaced apart from the pressure chamber to define a volume therebetween that receives gases produced during the burning of the propellant charge and released into the pressure vessel via the vent holes. A pressure valve divides the volume into a forward section adjacent the pressure chamber and an aft section adjacent the piston. The pressure valve is configured to remain closed until a threshold pressure is reached in the forward section at which point the pressure valve opens to join the forward section with the aft section. A countermass is positioned between the piston and the second end of the pressure vessel. When the pressure valve opens, the gases in the volume act on the pressure chamber and the piston. As a result, the projectile with the pressure vessel sealed thereto is propelled in a first direction in the launch tube and the piston moves in a second direction in the launch tube opposite that of the first direction. The piston travels to the second end of the pressure vessel to drive the countermass (e.g., a fluid) out of the pressure vessel at the second end while the gases remain sealed in the pressure vessel which is launched with the projectile.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
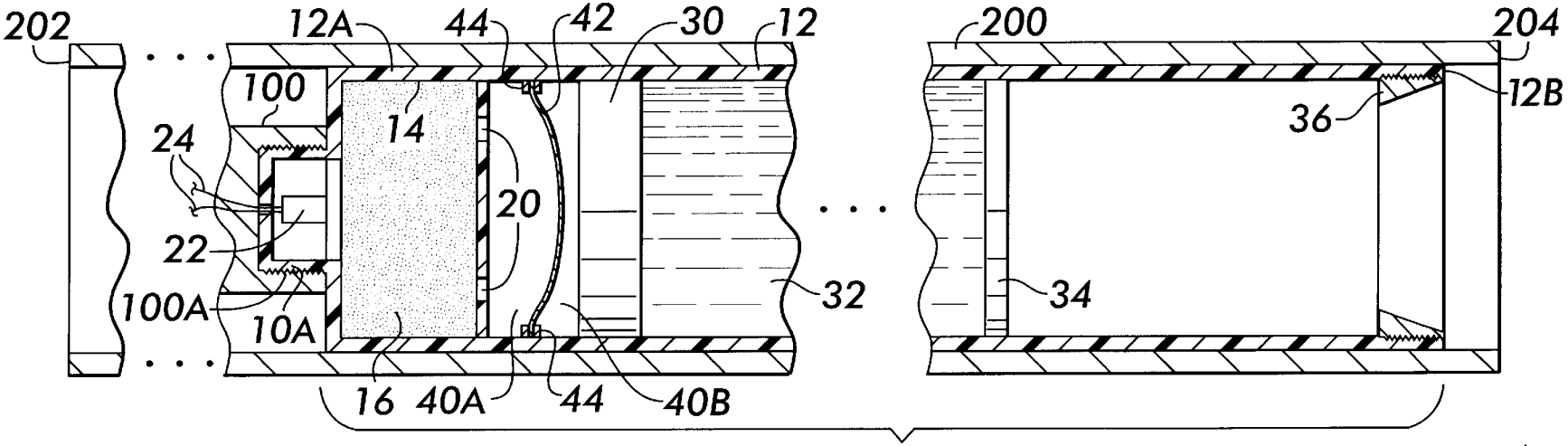
FIG. 1 is a cross-sectional view of one embodiment of a device that provides a recoilless and gas-free launch of a projectile from a launch tube in accordance with the present invention.
Figure 2:
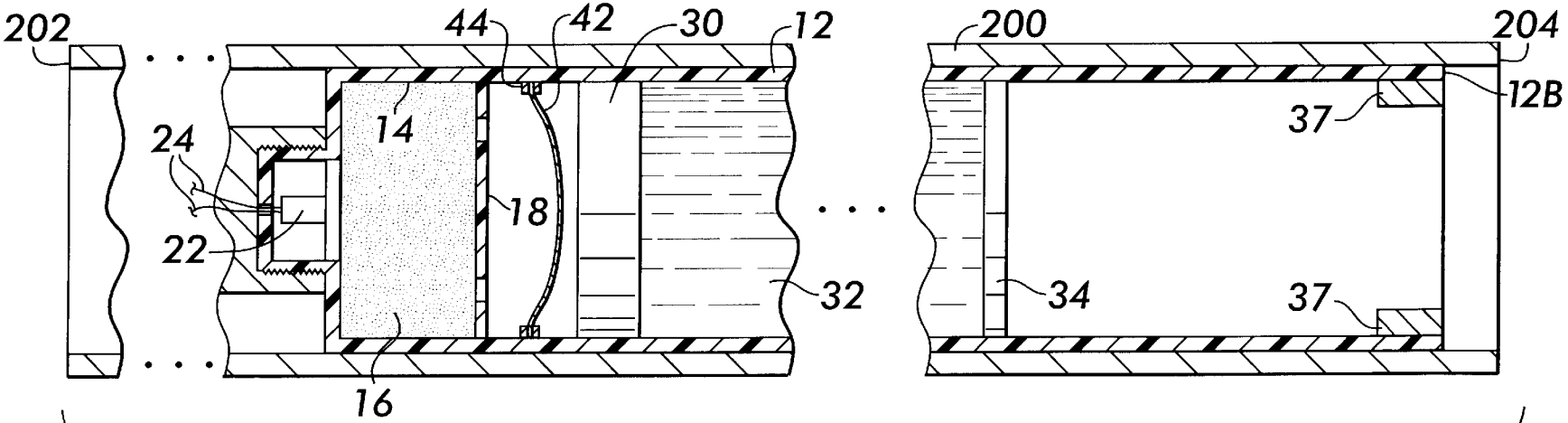
FIG. 2 is a cross-sectional view of another embodiment of the present invention.

Referring now to the drawings, and more particularly to FIG. 1, one embodiment of a device that provides a recoilless and gasless launch of a projectile is shown and referenced generally by numeral 10. Device 10 is coupled to the aft end of a projectile 100. The choice of projectile 100 is not a limiting factor in use of the present invention as long as device 10 can be fixed or fixably attached to the aft end thereof. Such coupling can be made, for example, by threaded engagement of threads 10A on device 10 with threads 100A on projectile 100. Another option is to make device 10 integral with projectile 100. Both device 10 and projectile 100 can be placed in any launch tube 200 that has open muzzle 202 and open breach 204 at launch. As will be explained further below, open muzzle 202 provides for the discharge of projectile 100 and a portion of device 10 while open breach 204 provides for the discharge of the countermass used in the present invention.

The exterior of device 10 is a pressure vessel 12 that is coupled to the aft end of projectile 100 as described above.

Pressure vessel 12 is typically constructed from a lightweight material since it is to travel with projectile 100 at launch. At the same time, pressure vessel 12 must be strong enough to contain the generated launch forces. Materials satisfying this criteria include carbon, polyethylene or other man-made fiber materials such as materials made with fibers manufactured by Allied Signal Inc. under the registered trademark SPECTRA or fibers manufactured by E. I. Du Pont De Nemours and Company under the registered trademark KEVLAR.

Defined in and at the forward end of pressure vessel 12 is a pressure chamber 14 housing a propellant charge material 16 therein. Pressure chamber 14 can be formed by a forward portion 12A of pressure vessel 12 that terminates at a plate 18 having vent holes 20 passing therethrough. Plate 18 can be fixed in position or made integral with pressure vessel 12. Alternatively, pressure chamber 14 can be separately constructed and sealed in the forward portion of pressure vessel 12.

A squib 22 or other ignitor is placed in contact with propellant charge 16. Ignition of squib 22 can be controlled by, for example, a control signal sent over wires 24 as is known in the art. The choice of propellant charge 16 and squib 22 depend upon the particular application and is not a limitation of the present invention. The number and size of vent holes 20 are selected for the efficient and consistent burning of propellant charge 16. In the field of prop charge propulsion, "efficient and consistent" burning of a propellant means that all of propellant 16 burns at a steady and fast rate. Further, such results must be repeatable in a plurality of identically constructed devices.

Positioned aft of pressure chamber 14 is an arrangement of components that make up a countermass assembly that includes a piston 30, a fluid countermass 32, a rupturable or frangible seal 34 sealed in pressure vessel 12 and, optionally, a nozzle 36 attached to the aft open-end 12B of pressure vessel 12. Piston 30 is positioned in pressure vessel 12 to define a volume into which propellant gases will be discharged as will be explained further below. Piston 30 is sealed within pressure vessel 12 in such a manner that it can slide therealong.

The volume between plate 18 and piston 30 is divided into a forward section 40A and an aft section 40B by a pressure valve in the form of a rupturable disk or diaphragm 42. Diaphragm 42 is typically a thin piece of metal (e.g., steel) which is concave relative to plate 18 and convex relative to piston 30. Diaphragm 42 is configured (e.g., scored) to rupture or burst when its design pressure is exceeded. In the present invention, pressure build-up of prop charge exhaust gases occurs in forward section 40A as will be explained in detail below. Such diaphragms are available commercially from, for example, Continental Disk Corporation, Liberty, Mo. These diaphragms generally come in a wide variety of diameters and burst pressures, and can be made to open or fail at very precise pressure values. Diaphragm 42 can be held in place by a clamping collar 44 that clamps axially on an outside edge of diaphragm 42.

As propellant 16 burns and vents through holes 20, forward section 40A increases in pressure relative to aft section 40B as long as diaphragm 42 remains intact. Diaphragm 42 fixes the volume into which exhaust gases (from burning propellant 16) are vented thereby providing for the efficient and consistent burn of propellant 16. That is, since propellant 16 must be under high pressure (typically about 15,000 psi) for most types of propellant 16 to burn efficiently and consistently, diaphragm 42 keeps the exhaust gas volume constant until the burn is well under way. Diaphragm 42 also controls when the exhaust gases are released to the area (i.e., aft section 40B) where they can push the countermass out. That is, diaphragm 42 prevents any unnecessary motion of piston 30 until the pressure in forward section 40A is sufficient to rupture diaphragm 42. In this way, piston 30 only starts to move when it is time for the countermass to be ejected. This helps minimize the overall length of launch tube 200 since no launch tube length is wasted on preliminary movement of piston 30. Such preliminary movement would occur if exhaust gas pressure were allowed to build-up directly against piston 30.

Fluid countermass 32 is any non-toxic fluid or fluid-like substance selected to offset the launch forces acting on projectile 100. Good choices for fluid countermass 32 include water, silicone oil, etc., with denser fluids being used for larger projectiles in order to reduce the amount needed. Seal 34 is a frangible or rupturable seal designed to fail as piston 30 moves rearward in pressure vessel 12. Seal 34 could alternatively be designed to fail along its periphery and be ejected at aft end 12B.

In the illustrated embodiment, nozzle 36 is a converging nozzle that is in threaded engagement with aft end 12B. Accordingly, the present invention is easily adapted to a particular application since different types of nozzles can be used to fine tune the discharge of fluid countermass 32. This increases the flexibility of the present invention.

In operation, device 10 along with projectile 100 are inserted into a launch tube. When squib 22 is ignited, propellant charge 16 burns in pressure chamber 14 to produce gases. The gases pass through vent holes 20. The exhaust gases act on pressure vessel 12 and projectile 100 in an attempt to propel them forward in launch tube 200. The exhaust gases are also simultaneously acting on diaphragm 42. Motion in opposing directions is actually achieved when the pressure in forward section 40A is sufficient to bring about the failure of diaphragm 42. At that point, projectile 100 (along with pressure vessel 12 as attached thereto) moves forward, while piston 30 moves rearward thereby increasing the pressure on fluid countermass 32. As seal 34 fails, fluid countermass 32 is ejected from aft end 12B and breach 204.

Ejection of fluid countermass 32 can be controlled by the use of nozzle 36. The geometry of nozzle 36 controls the rate and manner by which fluid countermass 32 is ejected. For example, if nozzle 36 is a converging nozzle as shown, fluid countermass 32 is ejected at an increasing rate as piston 30 moves further aft. As a result, the later ejected portion of fluid countermass 32 impinges upon the earlier ejected portion of fluid countermass 32 thereby causing impinging portions thereof to scatter radially. This increases the cross-sectional area of the discharge which causes it to also decrease in velocity. Finally, as piston 30 reaches aft end 12B, piston 30 comes to a stop at nozzle 36 in the case of a converging nozzle. The gases within volume 40 are thus contained within pressure vessel 12 and travel with projectile 100. Note that if nozzle 36 is a diverging nozzle or is not used, limit stops (not shown in FIG. 1) can be placed inside pressure vessel 12 to "catch" piston 30 at aft end 12B.

The advantages of the present invention are numerous. The device combines efficient and consistent burning of a propellant charge with a safe countermass system since no exhaust gases are discharged. The full containment of the exhaust gases produced during the rocket burn also eliminates the flash and/or smoke discharge. The containment of the exhaust gases also greatly reduces the acoustic report during launch. By isolating the countermass assembly from exhaust gas pressure until the desired pressure is reached, launch tube length can be kept to a minimum thereby reducing the size and cost of the launching system. This allows shoulder launchers to make use prop charges instead of rockets for launch propulsion.

Although the invention has been described relative to a specific embodiment thereof, there are numerous variations and modifications that will be readily apparent to those skilled in the art in light of the above teachings. For example, as mentioned above, if no nozzle (or a diverging nozzle) is used at aft end 12B, a retainer such as limit stops 37 could be placed about the inside periphery of pressure vessel 12 to catch piston 30 as it travels towards aft end 12B. It is therefore to be understood that, within the scope of the appended claims, the invention may be practiced other than as specifically described.

What is claimed as new and desired to be secured by Letters Patent of the United States is:

1. A device for the recoilless propulsion of a projectile from a launch tube comprising:

a hollow pressure vessel sealed on a first end thereof to an aft end of a projectile in a launch tube and open on a second end thereof;

a pressure chamber defined in a forward portion of said pressure vessel, said pressure chamber having vent holes vented to said pressure vessel aft of said pressure chamber;

a propellant charge loaded into said pressure chamber;

a piston sealed within said pressure vessel for sliding movement therein, said piston spaced apart from said pressure chamber to define a volume therebetween that receives gases produced during the burning of said propellant charge, said gases being released into said pressure vessel via said vent holes;

a pressure valve dividing said volume into a forward section adjacent said pressure chamber and an aft section adjacent said piston, said pressure valve configured to remain closed until a threshold pressure is reached in said forward section at which point said pressure valve opens to join said forward section with said aft section; and a countermass positioned between said piston and said second end of said pressure vessel wherein, when said pressure valve opens, said gases in said volume act on said pressure chamber and said piston whereby said projectile with said pressure vessel sealed thereto is propelled in a first direction in said launch tube and said piston moves in a second direction in said launch tube opposite that of said first direction, said piston driving said countermass out of said pressure vessel at said second end.

2. A device as in claim 1 wherein said countermass is a fluid, said device further comprising a seal positioned between said piston and said second end of said pressure vessel to define a sealed compartment therebetween for containing said fluid, said seal configured to fail when said piston moves in said second direction.

3. A device as in claim 1 further comprising a nozzle coupled to said second end of said pressure vessel.

4. A device as in claim 3 wherein said nozzle is a converging nozzle.

5. A device as in claim 3 wherein said nozzle and said second end are removably coupled to one another.

6. A device as in claim 1 wherein said pressure vessel is constructed from a fiber material.

7. A device as in claim 1 further comprising a limit stop coupled near said second end of said pressure vessel for stopping said piston from moving in said second direction wherein said gases are prevented from exiting said second end.

8. A device as in claim 1 wherein said pressure vessel is a frangible diaphragm.

9. A device for the recoilless propulsion of a projectile from a launch tube comprising:

a hollow pressure vessel sealed on a first end thereof to an aft end of a projectile in a launch tube and open on a second end thereof;

a pressure chamber defined in a forward portion of said pressure vessel, said pressure chamber having vent holes vented to said pressure vessel aft of said pressure chamber;

a propellant charge loaded into said pressure chamber;

a fluid countermass assembly sealed within said pressure vessel and spaced apart from said pressure chamber to define a volume therebetween, said fluid countermass assembly containing a fluid;

a pressure valve dividing said volume into a forward section adjacent said pressure chamber and an aft section adjacent said countermass assembly, said forward section receiving gases produced during the burning of said propellant charge and released into said pressure vessel via said vent holes, said pressure valve configured to remain closed until a threshold pressure is reached in said forward section at which point said pressure valve opens to join said forward section with said aft section, wherein said gases in said volume act on said pressure chamber and said fluid countermass assembly whereby said projectile with said pressure vessel sealed thereto is propelled in a first direction in said launch tube and said fluid countermass assembly ruptures such that said fluid moves in a second direction in said launch tube opposite that of said first direction, said fluid exiting said pressure vessel at said second end; and a nozzle coupled to said second end of said pressure vessel.

10. A device as in claim 9 wherein said nozzle is a converging nozzle.

11. A device as in claim 9 wherein said nozzle and said second end are removably coupled to one another.

12. A device as in claim 9 wherein said pressure vessel is constructed from a fiber material.

13. A device as in claim 9 further including a retainer for retaining said gases within said pressure vessel as said fluid exits said pressure vessel at said second end.

14. A device as in claim 9 wherein said pressure vessel is a frangible diaphragm.

15. A device for the recoilless propulsion of a projectile from a launch tube comprising:

a hollow pressure vessel sealed on a first end thereof to an aft end of a projectile in a launch tube and open on a second end thereof;

a pressure chamber defined in a forward portion of said pressure vessel, said pressure chamber having vent holes vented to said pressure vessel aft of said pressure chamber;

a propellant charge loaded into said pressure chamber;

a piston sealed within said pressure vessel for sliding movement therein, said piston spaced apart from said pressure chamber to define a volume therebetween that receives gases produced during the burning of said propellant charge and released into said pressure vessel via said vent holes;

a pressure valve dividing said volume into a forward section adjacent said pressure chamber and an aft section adjacent said piston, said pressure valve configured to remain closed until a threshold pressure is reached in said forward section at which point said pressure valve opens to join said forward section with said aft section;

a rupturable seal positioned between said piston and said second end of said pressure vessel to define a sealed compartment therebetween;

a fluid contained in said sealed compartment wherein, when said pressure valve opens, said gases in said volume act on said pressure chamber and said piston whereby said projectile with said pressure vessel sealed thereto is propelled in a first direction in said launch tube and said piston moves in a second direction in said launch tube opposite that of said first direction, said piston pressurizing said fluid to cause said rupturable seal to fail when said piston moves in said second direction wherein said fluid is driven out of said pressure vessel at said second end;

a nozzle coupled to said second end of said pressure vessel; and a retainer coupled near said second end of said pressure vessel for stopping said piston from moving in said second direction wherein said gases are prevented from exiting said second end by said piston.

16. A device as in claim 15 wherein said nozzle is a converging nozzle, said converging nozzle further serving as said retainer.

17. A device as in claim 15 wherein said nozzle and said second end are removably coupled to one another.

18. A device as in claim 15 wherein said pressure vessel is constructed from a fiber material.

19. A device as in claim 15 wherein said pressure vessel is a frangible diaphragm.

* * * * *